United States Patent [19]

Baur

[11] 4,193,881

[45] Mar. 18, 1980

[54] LUBRICANT FOR METAL STRIP

[75] Inventor: Rudolf Baur, Kreuzlingen, Switzerland

[73] Assignee: Swiss Aluminium Ltd., Chippis, Switzerland

[21] Appl. No.: 936,828

[22] Filed: Aug. 25, 1978

[30] Foreign Application Priority Data

Sep. 6, 1978 [CH] Switzerland ..... 10845/78

[51] Int. Cl.[2] ..... C10M 5/16; C10M 5/14; C10M 7/22; C10M 7/20

[52] U.S. Cl. ..... 252/17; 72/42; 252/35; 252/36; 252/39; 252/52 R; 252/56 S; 585/3

[58] Field of Search ..... 72/42; 252/17, 36, 35, 252/39, 56 S, 52 R; 585/3

[56] References Cited

U.S. PATENT DOCUMENTS

| | | | |
|---|---|---|---|
| 2,266,544 | 12/1941 | Freuler | 252/36 |
| 2,489,300 | 11/1949 | Leyda | 252/36 |
| 2,525,984 | 10/1950 | Weston | 252/36 |
| 3,392,117 | 7/1968 | Glasson | 252/17 |
| 3,519,571 | 7/1970 | Szczepanek et al. | 252/36 |

*Primary Examiner*—Irving Vaughn
*Attorney, Agent, or Firm*—Backman and LaPointe

[57] ABSTRACT

A lubricant for metal strip, in particular metal strip made of aluminum or aluminum alloy, and used for packaging purposes, in particular for packaging foodstuffs. The lubricant contains the aluminum or magnesium salt of a saturated $C_{11}$ to $C_{19}$ monocarboxylic acid as its main constituent. The lubricant also contains a dispersing agent.

15 Claims, 2 Drawing Figures

LUBRICANT FOR METAL STRIP

BACKGROUND OF THE INVENTION

The invention concerns a lubricant for metal strip, in particular for blank and painted strips made of aluminum or aluminum alloys and used for packaging, in particular for the packaging of foodstuffs.

Containers which can be used in the packaging of foodstuffs and the like, can be produced in a conventional manner by deep drawing material such as aluminum strip which is generally blank or painted before this operation. In order that the strip can be readily processed in various subsequent operations, the surface of the strip must exhibit good slip properties. Depositing a lubricant on the surface of the strip in one of the production steps (after painting, for instance) produces the desired effects. The surfaces bearing a lubricant must meet the following requirements:

(a) The ease of slip between two surfaces with a lubricant on them must be as great as possible.

(b) Easy slip must be maintained for a long time, more than two years, for instance. The substance providing easy slip must be able to withstand air, oxygen and light under normal storage conditions and must not lose its lubricating properties.

(c) The lubricating effect of the slip promoting agent must be so good that the material bearing the lubricant can be used, without any additional lubricant, for the production of containers by deep drawing.

(d) The lubricant must not give off any smell. In particular, the blank or painted thin strip product bearing the lubricant must not give off any smell when heated. In other words, the lubricant must exhibit thermal stability.

(e) The coating of lubricant must prevent the contents from sticking to the sheet, even after relatively strong heating, such as in baking.

(f) The coating of lubricant on baked lacquer coated strip may alter the thermal sealing characteristics only to a controllable degree.

(g) The lubricant must not react with lacquer coatings and must not cause swelling or dissolution of lacquer coatings. The components making up the lubricant must be in full accordance with the laws concerning foodstuffs.

The fluid substances used as lubricants up to now, such as paraffin oil and synthetic triglyceride, fulfill the above requirements only in part.

Furthermore, in some countries efforts are being made which would to a large degree prevent paraffin oil from being used as a lubricant on containers for foodstuffs.

SUMMARY OF THE INVENTION

Therefore, the inventor has developed the surface lubricant of the present invention which satisfies the above-listed requirements. In addition, the lubricant of the present invention exhibits no toxic effects and thus enjoys the approval of the laws covering foodstuffs.

The lubricant of the present invention achieves the foregoing objectives and contains the aluminum or magnesium salt of a saturated $C_{11}$ to $C_{19}$ monocarboxylic acid as its main constituent.

The aluminum or magnesium monocarboxylic acid salt is preferably aluminum stearate or magnesium di-stearate. In most cases, it has been found necessary to have in the constitution of the lubricant a minimum of 60% aluminum or magnesium monocarboxylic acid salt.

The appropriate stearate of aluminum or magnesium monocarboxylic acid salt has been found to be particularly advantageous.

DETAILED DESCRIPTION

Figure 1:
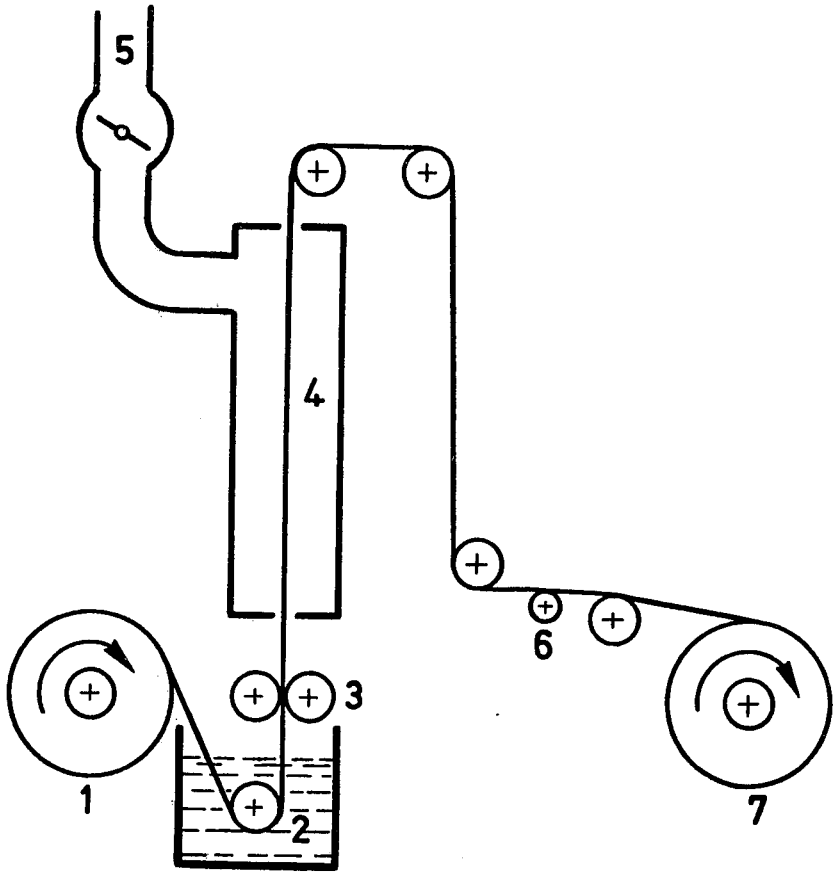

Extensive plant trials also show that aluminum tri-stearate in most cases produces a somewhat better lubricating effect than magnesium di-stearate. The lubricating properties of magnesium di-stearate, on the other hand, are significantly better than those of the rest of the alkali-earth di-stearates.

Research also shows, however, that aluminum and magnesium monocarboxylic acid salts can be applied on an industrial scale only with great difficulty.

In an advantageous embodiment of the lubricant of the present invention, these difficulties can be overcome, at least in part, by the addition of application agents. Surprisingly, research indicates that, in the use of mixtures of aluminum and magnesium monocarboxylic acid salts, the small quantity of monocarboxylic acid salt added as an application agent to assist in application of the lubricant is not suitable as the main constituent of the lubricant of the invention comprising mainly other monocarboxylic acids.

Both monocarboxylic acid salts can thus be used in any mixed ratio desired. Using basically the following mixtures (weight %), however, has been found most advantageous for lubricants:

85–95%, preferably 89–94% of an aluminum salt of a saturated $C_{11}$ to $C_{19}$ monocarboxylic acid, and 5–15%, preferably 6–11% of a magnesium salt of a saturated $C_{11}$ to $C_{19}$ monocarboxylic acid, or 85–95%, preferably 89–94% of a magnesium salt of a saturated $C_{11}$ to $C_{19}$ monocarboxylic acid, and 5–15%, preferably 6–11% of an aluminum salt of a saturated $C_{11}$ to $C_{19}$ monocarboxylic acid.

The use of mixtures of aluminum and magnesium monocarboxylic acid salts affect the lubricating properties of the main component of the lubricant of the invention only insignificantly. Usefully, the same monocarboxylic acid, stearic acid for example, is employed for the main constituent of the lubricant as for the application agent; however, mixtures such as the following can also be used:

aluminum stearate as the main constituent of the lubricant and magnesium di-laurate as the application agent; or magnesium di-stearate as the main constituent of the lubricant and aluminum tri-laurate as the application agent.

The metal strip intended for packaging purposes is, in many cases, coated with lubricant immediately after the lacquering. Thus, it had to be determined whether the lubricant of the present invention could be deposited on the surface of the strip from a solution or a dispersion from an aliphatic solvent such as is normally used in lacquering technology, n-hexane, for instance. This requirement causes difficulties in that neither, the magnesium or aluminum salts of long chain monocarboxylic acids nor a mixture of both are soluble or dispersible in large quantities in aliphatic solvents. But these problems can be overcome by the addition of a further application agent, namely, a dispersion agent. The following classes of substances have proved of value as

- synthetic triglycerides,
- paraffin oils,

- poly-isobutenes,
- aliphatic $C_4$ to $C_{16}$ alcohols,
- esters of a methyl or ethyl alcohol with a $C_{11}$ to $C_{17}$ monocarboxylic acid,
- esters of a $C_3$ to $C_6$ alcohol with a saturated $C_{11}$ to $C_{17}$ monocarboxylic acid,
- esters of an aliphatic $C_1$ to $C_6$ alcohol with a $\omega$-oxymonocarboxylic acid.

The methyl and ethyl esters of the $C_{11}$ to $C_{17}$ monocarboxylic acids, particularly lauric acid, have proven especially useful.

Table IA presents examples of the compositions of two lubricants conforming to the present invention. Naturally, the listed substances in Table IA, aluminum tri-stearate, magnesium di-stearate and methyl palmitate, can be replaced by other members of their groups of substances in accordance with the present invention as shown in Table IB.

TABLE IA

| Lubricant Component | Composition No. 1A (wt %) | Composition No. 2A (wt %) |
|---|---|---|
| Aluminum tri-stearate | 60–80 | 2–10 |
| Magnesium di-stearate | 2–10 | 60–80 |
| Methyl palmitate | 10–30 | 10–30 |

TABLE IB

| Lubricant Component | Composition No. 1B (wt %) | Composition No. 2B (wt %) |
|---|---|---|
| Aluminum salt of a saturated $C_{11}$ to $C_{19}$ monocarboxylic acid | 60–80 | 2–10 |
| Magnesium salt of a saturated $C_{11}$ to $C_{19}$ monocarboxylic acid | 2–10 | 60–80 |
| Dispersion agent | 10–30 | 10–30 |

Liquid aliphatic hydrocarbons, in particular n-hexane, which are often used as solvents in lacquer technology, have been found to be particularly suitable for the preparation of dispersions of the lubricant of the present invention. This solvent boils at 69° C., gives off almost no smell and, in particular in coats of lacquer, causes no microscopic brittle cracks as can be observed in many cases when aliphatic alcohols or aliphatic ketones are used as solvents. The amounts of n-hexane taken up by the lacquer during the coating of the lacquered strip with the lubricant of the present invention are small and are to a large extent evaporated off by the subsequent drying. Thus, the residual amount of solvent hardly affects the lacquer coating. When coating blank metal strip, however, aliphatic alcohols or ketones can also be used. Their use, though, is preferably limited to the treatment of blank strip since they, as mentioned above, can cause microscopic brittle cracks in the lacquer.

By using the dispersions prescribed by the invention, exceptionally stable dispersions can be formed in aliphatic solvents. Some dispersions tend to settle as a precipitate to a certain degree after standing for a while. In these substances, the precipitated particles of the metal salts of long chain monocarboxylic acids can be immediately agitated into suspension again by means of only the slightest amount of stirring.

These dispersion agents have been found to a certain degree to cause unpleasant odors on heating (e.g., baking) lubricants, in particular those intended for food packaging. These odors are partly due to impurities in the dispersion agent. Therefore, it is extremely important to use dispersion agents which are at least of the grade "purified" in the preparation of lubricants for foodstuff packaging. Lubricants comtaining methyl and ethyl esters of the saturated $C_{11}$ to $C_{17}$ monocarboxylic acids, either individually or mixtures thereof, have been shown to be particularly suitable for foodstuff packaging. The preferred dispersion agent is methyl palmitate.

Substances of the rest of the classes of such chemicals can be more usefully employed for packaging strip used for applications other than the packaging of foodstuffs.

Table II shows a typical and particularly useful composition of a dispersion agent for the surface lubricant of the invention.

TABLE II

| Dispersion Component | Range (wt %) | Preferred Range (wt %) |
|---|---|---|
| Aluminum tri-stearate | 2.5–10.0 | 4.0–6.5 |
| Magnesium di-stearate | 0.1–1.5 | 0.3–0.7 |
| Methyl palmitate | 0.8–3.0 | 1.2–2.0 |
| n-hexane | 85.5–96.6 | 91.0–94.0 |

Such a dispersion exhibits excellent stability even after standing for several months, displaying only very slight precipitation.

A further similarly advantageous composition of the dispersion in accordance with the present invention can be obtained when the concentrated ranges in Table II for aluminum tri-stearate and magnesium di-stearate are reversed.

These dispersion agents, which represent a component of the lubricant on the metal strip after drying, also exhibit a certain degree of lubrication. With these agents, however, the degree of lubrication is not as pronounced as that of the aluminum and magnesium monocarboxylic acid salts. Furthermore, this property may lessen in the course of time due to oxidation of the dispersion agent. In extreme cases, in particular with triglycerides, oxidation of the dispersion agent can result in the conversion of the lubricant into a sticky film which makes the sheet coated with the substance unusable. In these cases, the duration, that is, the period of time which these lubricants containing oxidation sensitive dispersion agents are allowed to stand, can be extended by the addition of at least one further additive, a so called oxidation inhibitor. Such alterations have been so successful that these oxidation sensitive dispersion agents can also be employed on an industrial scale. The oxidation inhibitors are usefully added in quantities equal to that of the dispersion agent. There are, however, compositions of lubricants in which the concentration of oxidation inhibitors is larger or smaller than that of the dispersion agent. Such compositions are not only usable but, in some cases, are even advantageous. Palmitoyl ascorbate is one such oxidation inhibitor.

Only those lubricants which contain dispersion agents which are suitable for foodstuff packaging, i.e., methyl and ethyl ester saturated $C_{11}$ to $C_{17}$ monocarboxylic acids, show no change in the lubricating properties due to oxidation of the dispersion agent.

The dispersion can be prepared by adding the components of the lubricant, i.e., the aluminum and magnesium monocarboxylic salts, the dispersion agent and the anti-oxidation agent to a solvent. The resulting mixture is then heated for a long period of time, such as 6 to 8 hours, in a reflux apparatus in such a way that the solvent boils continuously. A milk white dispersion of swollen metal stearate particles in the solvent results. In extreme cases, such as when employing special dispersion agents, a solution may be obtained. The deposition of the lubricant on the surface of the strip can take place using the usual methods and equipment employed in lacquer technology. Processes and devices for immersion coating or varnishing have been found to be favorable for this purpose. Thus, the packaging strip is, by way of preference, coated on both sides with the lubricant of the invention.

The packaging industry usually employs aluminum and its alloys in the form of strip which can be coated on one or both sides with lacquer or else laminated with another material. The thickness of these aluminum or aluminum alloy strips varies, depending on the application, from 10 to 250 μm. The thickness of the lacquer or laminate coating of one or, if desired, both sides of the strip is preferably between 1 and 100 μm.

The amount of lubricant deposited must be chosen with the later processing of the strip in mind. Preferably, each side receives between 10 and 150 mg/m$^2$. If the strip is to be used for the packaging of foodstuffs, then the appropriate legal specifications must be taken into account when determining the amount of lubricant to be deposited.

When used on blank and lacquered strip material, the lubricant of the invention satisfies all the requirements set by the packing industry, in particular:

(a) The manufacture of deep drawn containers without application of additional lubricants before or during the shaping process.

(b) Agent to allow stamped out, stacked metal lids to be separated individually on the assembly line automatically and without difficulty.

(c) Separating agent for baked products (in particular products with a high sugar content) to allow easy removal of the contents, such as from an aluminum mold or tray after baking.

(d) Easy removal of stacked metal sheet used as blanks for the production of folded containers.

(e) Application as a lubricant for aluminum foils and strips to be processed further by unloading from coil form by equipment, as for wrapping for chocolate and the like.

Deep drawn packaging containers made from lacquered or laminated aluminum strip, coated with the lubricant according to the present invention, can be sealed tight with a lid in the normal manner by means of heat sealing. This process differs from sealing done with conventional paraffin oil based lubricants only in that in certain cases it requires a slightly higher sealing temperature to achieve airtight sealing of the package. This requirement can be met on industrial packaging machines simply by raising the temperature and without any kind of difficulty arising and without incurring any disadvantage.

Figure 2:
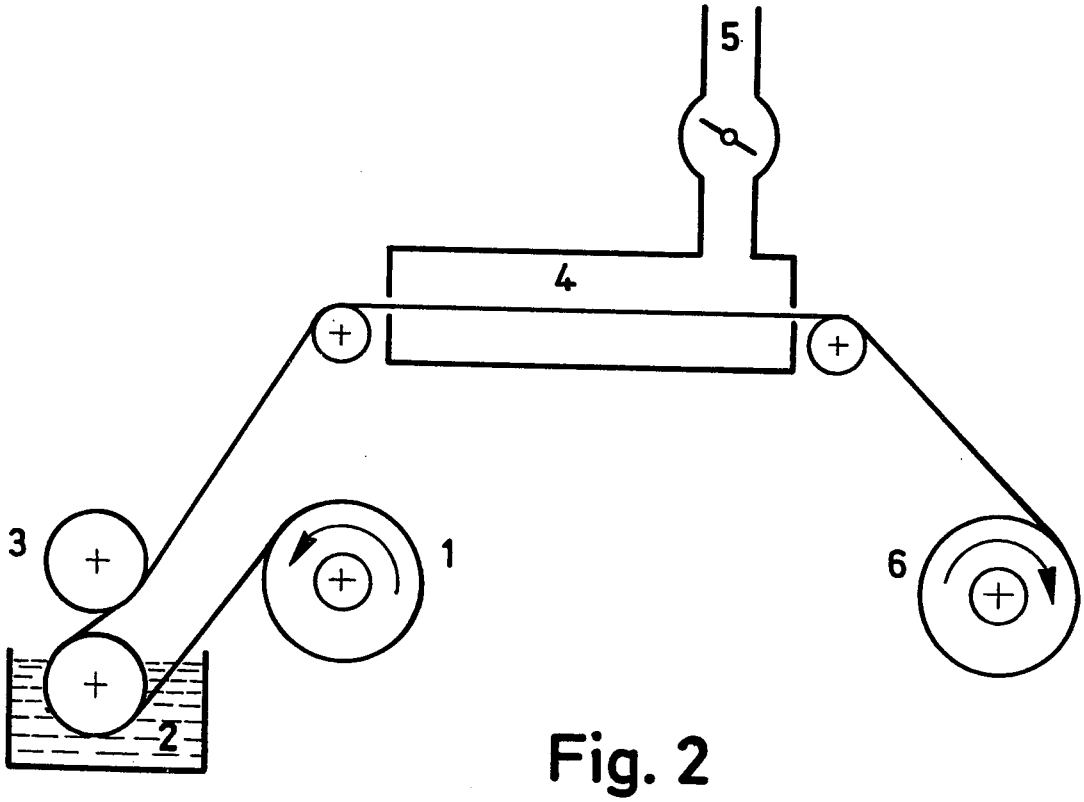

FIGS. 1 and 2 show schematically two devices which are particularly favorable for applying the lubricant of the invention to strip material.

FIG. 1 shows a device comprising an uncoiling roll 1, a container 2 holding the dispersion, squeeze rolls 3, drying tunnel 4 with an exhaust pipe fitted with a fan to draw off the solvent vapor 5, circular knife-edge with backing 6 and a spool 7 on which the strip, coated with lubricant and trimmed, is coiled.

The quantity of lubricant deposited on the strip can be regulated by means of the squeeze rolls, one of which is made of steel, the other of rubber, fitted with facilities for pneumatic or mechanical adjustment of the pressure between them. When using n-hexane as solvent, the temperature in the drying tunnel is about 80° C.

FIG. 2 shows schematically a conventional lacquering device which has also been found to be particularly suitable for coating strip with the lubricant of the present invention. The device comprises an uncoiling roll 1, a bath 2 containing the dispersion, squeeze rolls 3, drying tunnel 4 with exhaust pipe and fan 5, and a roll 6 for coiling the strip which has been coated on both sides. As in the device shown in FIG. 1, the squeeze rolls 3 are preferably made of steel and/or rubber and the temperature in the drying tunnel is preferably around 80° C. when using n-hexane as the solvent. The squeeze rolls 3 are also provided with facilities for adjusting them mechanically. Thus, the amount of lubricant deposited on the sheet can be controlled.

Thus, a controlled amount of said lubricant can be applied to both sides of said strip by passing said strip through a bath of said lubricant to provide a lubricant coated strip and thereafter passing said lubricant coated strip through squeeze rolls to regulate the amount of lubricant remaining on said strip.

The following examples illustrate the advantages of the lubricant of the present invention.

EXAMPLE I

The effect of various dispersion agents will be illustrated using a lubricant of the following composition:

| | |
|---|---|
| aluminum tri-stearate | 91% |
| magnesium di-stearate | 9% |

The manner of testing was that 5.5 g of lubricant was added together with a specific amount of dispersion agent to 94.5 g n-hexane, and the resulting mixture boiled for 7 hours in a reflux apparatus.

The results given in Table III demonstrate the stability of the dispersion over a period of 30 days at 25° C., the degree of lubrication provided between two sheets of aluminum and the extent to which odor is produced by the coated aluminum when heated to 60° C. for 60 minutes.

The stability of the dispersion is arbitrarily defined as follows:

A stability of 100% means that the dispersion did not change during the entire test period.

A stability of 70% means that 30 vol.% comprised clear n-hexane above the dispersion.

A stability of 0% indicates that the dispersion has settled out in precipitate form.

The results presented in Table III show that usable lubricants can be obtained using all the dispersion agents listed. Clearly, though, methyl palmitate, i.e. dispersion agents of the group "esters of a $C_1$ or $C_2$ alcohol with a saturated $C_{11}$ to $C_{17}$ monocarboxylic acid", can be employed as constituents of a lubricant for food-packaging strip.

Furthermore, Table III shows that adequate lubrication can be achieved with all the dispersion agents, the amount of dispersion agent present being of no great significance. The degree of lubrication is classified in Table III as:

excellent,
very good,
good,
poor,
very poor.

TABLE III

| No. | Dispersion Agent Added (g/100 g) | Amount | Property: Dispersion: Kind of Solution | Dispersion: Stability 30 d, 25° C. | Lubricant Film: Degree of Lubrication Al/Al | Lubricant Film: Odor From Al 60° C., 60 min |
|---|---|---|---|---|---|---|
| 101 | | 1 g | | | | |
| 102 | synthetic triglyceride | 2 g | dispersion | 95% | good | no odor |
| 103 | | 3 g | | | | |
| 104 | | 1 g | | | | |
| 105 | paraffin oil | 2 g | dispersion | 90% | good | wax-like |
| 106 | | 3 g | | | | |
| 107 | | 1 g | | | | |
| 108 | Indopol H 100 | 2 g | dispersion | 90% | good | unpleasant |
| 109 | | 3 g | | | | |
| 110 | | 1 g | | | | |
| 111 | butyl laurate | 2 g | dispersion | 90% | very good | wax-like |
| 112 | | 3 g | | | | |
| 113 | | 1 g | | | | |
| 114 | lauryl alcohol | 2 g | dispersion | 70% | good | lauryl alcohol |
| 115 | | 3 g | | | | |
| 116 | | 1 g | | | | |
| 117 | methyl palmitate | 2 g | dispersion | 70% | excellent | no odor |
| 118 | | 3 g | | | | |
| 119 | | 1 g | clear | | | |
| 120 | glycolic acid butyl | 2 g | solution | 100% | good | mild odor |
| 121 | ester | 3 g | | | | |
| 123 | stearic acid butyl ester | 1 g | dispersion | 70% | very good | wax-like |

EXAMPLE II

A lubricant of the following composition:

| | |
|---|---|
| aluminum tri-stearate | 5 wt % |
| magnesium di-stearate | 0.5 wt % |
| methyl palmitate | 1.5 wt % |

was deposited on a blank aluminum strip using a device corresponding to that shown in FIG. 1. For this purpose, the lubricant of the above composition was boiled for 7 hours in a reflux apparatus in 93 wt % n-hexane as was already described earlier.

The dispersion produced this way was deposited on both sides of the aluminum strip in different quantities, which were than measured. The results are presented in Table IV.

TABLE IV

| Amount of Dispersion Deposited | 0.14 g/m² | 0.70 g/m² | 1.4 g/m² | 1.55 g/m² |
|---|---|---|---|---|
| Lubricant film | 10.0 mg/m² | 50.0 mg/m² | 100 mg/m² | 108.5 mg/m² |
| Al tri-stearate | 7.1 mg/m² | 35.5 mg/m² | 71 mg/m² | 77.8 mg/m² |
| Mg di-stearate | 0.7 mg/m² | 3.5 mg/m² | 7 mg/m² | 7.7 mg/m² |
| Methyl palmitate | 2.1 mg/m² | 10.5 mg/m² | 21 mg/m² | 23.0 mg/m² |

The regulations of the Food and Drug Administration permit aluminum tri-stearate and magnesium di-stearate to be in contact with foodstuffs, provided they do not exceed 310 mg/m² in quantity.

Similarly, the Food and Drug Administration allows deposits of methyl palmitate up to 23 mg/m².

Table IV shows that the lubricant of the present invention containing methyl palmitate as dispersion agent complies with the legal requirements, when the coating on the strip coming into contact with the contents exceeds a value of around 100 mg/m²/side.

This invention may be embodied in other forms or carried out in other ways without departing from the spirit or essential characteristics thereof. The present embodiment is therefore to be considered as in all respects illustrative and not restrictive, the scope of the invention being indicated by the appended claims, and all changes which come within the meaning and range of equivalency are intended to be embraced therein.

What is claimed is:

1. A lubricant for metal strip for the processing of blank and lacquered aluminum or aluminum alloy strip used for packaging purposes, in particular for packaging foodstuffs, said lubricant consisting essentially of a minimum of 60% of the aluminum or magnesium salt of a saturated $C_{11}$ to $C_{19}$ monocarboxylic acid or mixtures thereof as the main constituent and from 10 to 30% of at least one dispersion agent so that said lubricant may be deposited on the surface of the strip from a dispersion.

2. A lubricant according to claim 1 wherein the lubricant contains aluminum tri-stearate or magnesium di-stearate or mixtures thereof.

3. A lubricant according to claim 1 wherein said monocarboxylic acid salt constituent consists essentially of a mixture of:

85–95% of an aluminum salt of a saturated $C_{11}$ to $C_{19}$ monocarboxylic acid, and 5–15% of a magnesium salt of a saturated $C_{11}$ to $C_{19}$ monocarboxylic acid.

4. A lubricant according to claim 3 wherein said monocarboxylic acid salt constituent consists essentially of a mixture of:

89–94% of an aluminum salt of a saturated $C_{11}$ to $C_{19}$ monocarboxylic acid, and 6–11% of a magnesium salt of a saturated $C_{11}$ to $C_{19}$ monocarboxylic acid.

5. A lubricant according to claim 1 wherein said monocarboxylic acid salt constituent consists essentially of a mixture of:

85–95% of a mangesium salt of a saturated $C_{11}$ to $C_{19}$ monocarboxylic acid, and 5–15% of an aluminum salt of a saturated $C_{11}$ to $C_{19}$ monocarboxylic acid.

6. A lubricant according to claim 5 wherein said monocarboxylic acid salt constituent consists essentially of a mixture of:

89–94% of a magnesium salt of a saturated $C_{11}$ to $C_{19}$ monocarboxylic acid, and 6–11% of an aluminum salt of a saturated $C_{11}$ to $C_{19}$ monocarboxylic acid.

7. A lubricant according to claim 1 wherein mixtures of said aluminum and magnesium salts are used and wherein the aluminum salt and the magnesium salt are salts of the same monocarboxylic acids.

8. A lubricant according to claim 1 wherein the lubricant consists essentially of a mixture of:

60–80% of an aluminum salt of a saturated $C_{11}$ to $C_{19}$ monocarboxylic acid;

2–10% of a magnesium salt of a saturated $C_{11}$ to $C_{19}$ monocarboxylic acid; and 10–30% of at least one dispersion agent.

9. A lubricant according to claim 1 in which the lubricant consists essentially of a mixture of:

60–80% of a magnesium salt of a saturated $C_{11}$ to $C_{19}$ monocarboxylic acid;

2–10% of an aluminum salt of a saturated $C_{11}$ to $C_{19}$ monocarboxylic acid; and 10–30% of at least one dispersion agent.

10. A lubricant according to claim 1 wherein the lubricant contains at least one dispersion agent selected from the group consisting of:

synthetic triglycerides;

paraffin oils;

poly-isobutenes;

aliphatic $C_4$ to $C_{16}$ alcohols;

esters of a methyl or ethyl alcohol with a $C_{11}$ to $C_{17}$ monocarboxylic acid;

esters of an aliphatic $C_3$ to $C_6$ alcohol with a saturated $C_{11}$ to $C_{17}$ monocarboxylic acid;

esters of a $C_1$ to $C_6$ alcohol with a $\omega$-oxymonocarboxylic acid; and mixtures thereof.

11. A lubricant according to claim 10 wherein the dispersion agent is a methyl or ethyl ester of a saturated $C_{11}$ to $C_{17}$ monocarboxylic acid or mixtures thereof.

12. A lubricant according to claim 11 wherein the dispersion agent is methyl palmitate.

13. A lubricant according to claim 10 wherein the dispersion agent contains a solvent selected from the group of liquid aliphatic hydrocarbons, aliphatic alcohols, and aliphatic ketones.

14. A lubricant according to claim 13 wherein the solvent is n-hexane.

15. A lubricant according to claim 10 wherein the lubricant also contains an oxidation inhibitor.

* * * * *